US012727655B2

(12) United States Patent
Cheng et al.

(10) Patent No.: US 12,727,655 B2
(45) Date of Patent: Sep. 8, 2026

(54) REFILLABLE COLLARED CONTAINER FOR PRODUCT DISPENSING

(71) Applicant: L'Oreal, Paris (FR)

(72) Inventors: Wenzhen Cheng, Annadale, NJ (US); Rodney Hough, Mountainside, NJ (US); Harsh Patel, Howell Township, NJ (US)

(73) Assignee: L'Oreal, Paris (FR)

( * ) Notice: Subject to any disclaimer, the term of this patent is extended or adjusted under 35 U.S.C. 154(b) by 127 days.

(21) Appl. No.: 18/650,663

(22) Filed: Apr. 30, 2024

(65) Prior Publication Data

US 2025/0331623 A1 Oct. 30, 2025

(51) Int. Cl.

| | |
|---|---|
| ***A45D 34/00*** | (2006.01) |
| ***B65D 49/00*** | (2006.01) |
| ***B65D 53/02*** | (2006.01) |
| ***B65D 83/00*** | (2006.01) |

(52) U.S. Cl.

CPC ..... *A45D 34/00* (2013.01); *B65D 49/00* (2013.01); *B65D 53/02* (2013.01); *B65D 83/00* (2013.01); *A45D 2034/005* (2013.01)

(58) Field of Classification Search

None

See application file for complete search history.

(56) References Cited

U.S. PATENT DOCUMENTS

| | | | | |
|---|---|---|---|---|
| 5,154,328 | A | 10/1992 | Gueret | |
| 6,073,805 | A | 6/2000 | Gueret | |
| 6,622,890 | B2 | 9/2003 | Gueret | |
| 7,101,107 | B1 * | 9/2006 | Byun | B05B 11/0064 401/187 |

(Continued)

FOREIGN PATENT DOCUMENTS

| | | | |
|---|---|---|---|
| CN | 214509958 | U | 10/2021 |
| CN | 215958715 | U | 3/2022 |

(Continued)

OTHER PUBLICATIONS

Preliminary Search Report and Written Opinion mailed Dec. 9, 2024, issued in related FR Application No. 2406154, filed Jun. 11, 2024, 7 pages.

*Primary Examiner* — Matthew W Jellett

(74) *Attorney, Agent, or Firm* — Christensen O'Connor Johnson Kindness PLLC

(57) ABSTRACT

Rechargeable and non-rechargeable collared containers for airtight packaging of oxygen and/or moisture sensitive liquid formulas, such as retinol and retinol-containing compositions, for preservation of these substances. Collared containers include inner container collars that are able to be coupled with inner containers that store cosmetic substances therein. The inner container collars are securable to outer containers, and dispenser collars are securable to the outer containers for airtight storage and delivery of cosmetic substances within and from the inner containers and prevention of exposure of the cosmetic substances to air outside the outer containers. Airless pump dispensers can be used for creation of vacuums and maintenance of air-tight seals, and inner containers can be flexible pouches, flexible blow mold bottles, or rigid containers containing pistons.

14 Claims, 17 Drawing Sheets

(56) References Cited

U.S. PATENT DOCUMENTS

| | | | | |
|---|---|---|---|---|
| 7,314,329 | B1 * | 1/2008 | Byun | B05B 11/107 401/270 |
| 7,543,721 | B2 | 6/2009 | Binios et al. | |
| 8,499,970 | B2 * | 8/2013 | Yoo | G01F 1/666 222/154 |
| 8,608,029 | B2 * | 12/2013 | Lee | A45D 34/04 222/137 |
| 10,737,285 | B2 | 8/2020 | Toh et al. | |
| 11,084,646 | B1 * | 8/2021 | Hwang | B05B 11/0054 |
| 11,382,398 | B2 * | 7/2022 | Woo | A45D 34/00 |
| 11,745,200 | B2 | 9/2023 | Goettke et al. | |
| 2013/0008924 | A1 | 1/2013 | LaFosse | |
| 2016/0286932 | A1 | 10/2016 | Lee | |
| 2021/0153622 | A1 * | 5/2021 | Bickford | A45D 34/042 |
| 2022/0104600 | A1 * | 4/2022 | Woo | B05B 11/028 |
| 2022/0167724 | A1 | 6/2022 | Soulard et al. | |
| 2022/0330681 | A1 | 10/2022 | Zheng et al. | |

FOREIGN PATENT DOCUMENTS

| | | | |
|---|---|---|---|
| CN | 216701898 | U | 6/2022 |
| CN | 217199649 | U | 8/2022 |
| CN | 217228626 | U | 8/2022 |
| CN | 218807344 | U | 4/2023 |
| EP | 0 410 857 | A1 | 1/1991 |
| EP | 0945184 | A1 | 9/1999 |
| EP | 1166885 | A1 | 1/2002 |
| EP | 1444051 | B1 | 8/2004 |
| EP | 2103546 | A1 | 9/2009 |
| EP | 2534068 | B1 | 12/2012 |
| EP | 3034177 | A1 | 6/2016 |
| EP | 3934813 | B1 | 1/2022 |
| FR | 2846949 | A1 | 5/2004 |
| JP | 2008007160 | A | 1/2008 |
| JP | 2003072870 | B2 | 10/2008 |
| JP | 2017197281 | B2 | 11/2017 |
| JP | 2018090286 | B2 | 6/2018 |
| JP | 2018203313 | B2 | 12/2018 |
| JP | 2022157604 | A | 10/2022 |

* cited by examiner

REFILLABLE COLLARED CONTAINER FOR PRODUCT DISPENSING

SUMMARY

In an aspect, the disclosure provides a non-rechargeable collared container, comprising: an outer container comprising a vent and an upper aperture that each fluidly connects an interior of the outer container to an exterior of the outer container; an inner container securable within the interior of the outer container via a first snap fit connection between an inner container collar and the outer container; a dispenser securable to the outer container via a second snap fit connection between a dispenser collar and the outer container; and a lid securable to the dispenser collar; wherein securement of the first and second snap fit connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

In embodiments, securement of the lid to the dispenser collar forms a seal of the at least part of the plurality of seals for prevention of gas flow from the exterior of the outer container to the interior of the inner container and preservation of the cosmetic substance within the interior of the inner container.

In embodiments, a first seal of the plurality of seals is formed between the outer container and the inner container collar; a second seal of the plurality of seals is formed between the inner container collar and the dispenser collar; and a third seal of the plurality of seals is formed between the dispenser collar and the lid.

In embodiments, the first and second snap fit connections are annular snap fit connections.

In embodiments, the outer container comprises a rigid material and the vent is positioned at a bottom of the outer container.

In embodiments, the inner container collar is attached to the outer container prior to attachment of the dispenser collar to the outer container for formation of the at least part of the plurality of seals.

In embodiments, the dispenser collar is attached to the outer container prior to attachment of the lid to the dispenser collar for formation of a non-airtight seal of the plurality of seals.

In an aspect, the disclosure provides a rechargeable collared container, comprising: an outer container comprising a vent and an upper aperture that each fluidly connects an interior of the outer container to an exterior of the outer container; an inner container securable within the interior of the outer container via a first lockable threaded connection between an inner container collar and the outer container; a dispenser securable to the outer container via a second lockable threaded connection between a dispenser collar and the outer container; and a lid securable to the dispenser collar; wherein securement of the first and second lockable threaded connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

In embodiments, securement of the lid to the dispenser collar forms a seal of the at least part of the plurality of seals for prevention of gas flow from the exterior of the outer container to the interior of the inner container and preservation of the cosmetic substance within the interior of the inner container.

In embodiments, a first seal of the plurality of seals is formed between the outer container and the inner container collar; a second seal of the plurality of seals is formed between the inner container collar and the dispenser collar; and a third seal of the plurality of seals is formed between the dispenser collar and the lid.

In embodiments, the outer container comprises a rigid material and the vent is positioned at a bottom of the outer container.

In embodiments, the inner container collar is attached to the outer container prior to attachment of the dispenser collar to the outer container for formation of the at least part of the plurality of seals.

In embodiments, the dispenser collar is attached to the outer container prior to attachment of the lid to the dispenser collar for formation of a non-airtight seal of the plurality of seals.

In embodiments, the first lockable threaded connection occurs between an inner container collar member and an outer container collar member ridge, wherein the outer container collar member ridge is semi-circumferential such that the inner container collar member is rotatably movable relative to the outer container collar member ridge for transitions between an unlocked configuration and a locked configuration.

In embodiments, the second lockable threaded connection occurs between an outer container thread and a dispenser collar thread, wherein: a first rotational movement of the dispenser collar thread about the outer container thread passes a terminus of the dispenser collar over an abutment of the outer container thread and snap-secures the abutment of the outer container within a groove of the dispenser collar thread to form a locked configuration; and a second rotational movement of the dispenser collar thread about the outer container thread passes the terminus of the dispenser collar over the abutment of the outer container thread and snap-releases the abutment of the outer container from the groove of the dispenser collar thread to form an unlocked configuration.

In an aspect, the proposal of eco-responsible and environmentally friendly solutions which are designed and developed considering environmental issues is becoming a major goal in an effort to meet global challenges. It is therefore essential to design more sustainable products that reduce the amount of material used, replace existing materials with greener materials and use recyclable materials to reduce the carbon footprint of the products. In this context, it is important to offer recyclable packaging containing separable elements or consisting of a minimum of materials or being free of materials that are difficult to recycle, or combinations thereof to facilitate their end of life. Thus, it is necessary to develop packaging made of environmentally friendly recyclable materials to allow recovery of end-of-life packaging and avoid pollution of recycling processes.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

TABLE 1

Drawings reference numbers and descriptions

Figure 1A:
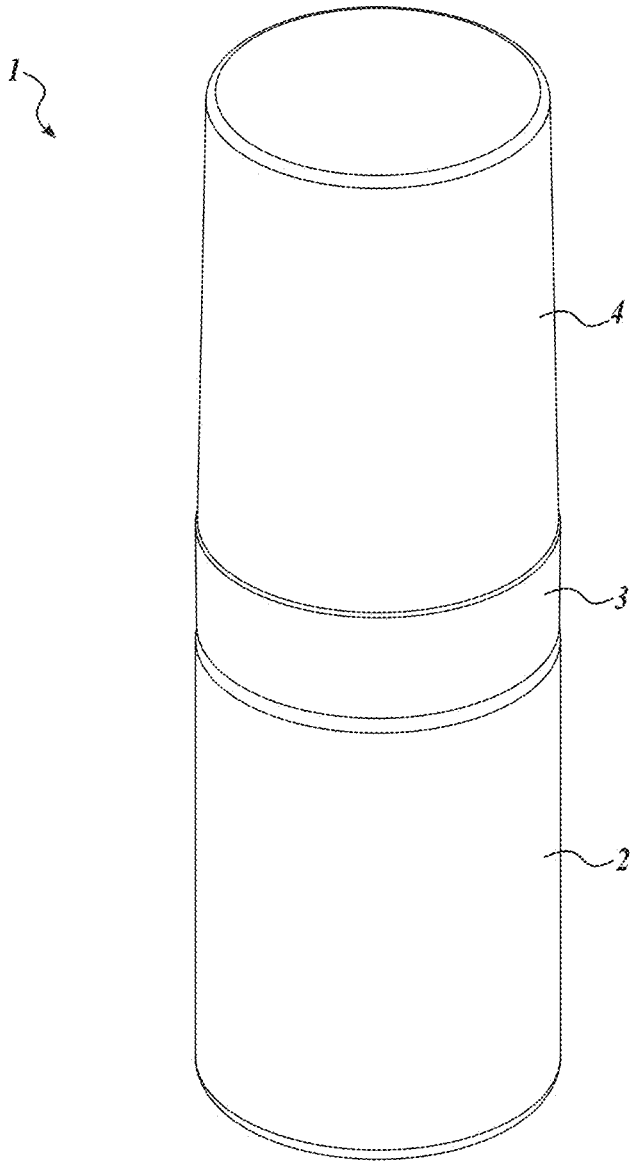
FIG. 1A shows a perspective view of a first example collared container that is non-rechargeable, according to aspects of the disclosure.

| Reference Number | Description |
|---|---|
| 1 | Collared container (non-rechargeable) |
| 2 | Outer container |
| 3 | Dispenser collar |
| 4 | Lid |
| 5 | Dispenser |
| 6 | Inner container collar |
| 7 | Inner container |
| 8 | Outer container vent |

TABLE 1-continued

Drawings reference numbers and descriptions

| Reference Number | Description |
|---|---|
| 9 | Inner container collar snap fit outer |
| 10 | Inner container collar snap fit inner |
| 11 | Outer container collar snap fit outer |
| 12 | Outer container collar snap fit inner |
| 13 | Outer container interior |
| 14 | Collared container (rechargeable) |
| 15 | Outer container |
| 16 | Dispenser collar |
| 17 | Lid |
| 18 | Dispenser |
| 19 | Inner container collar |
| 20 | Inner container collar thread |
| 21 | Outer container lip |
| 22 | Dispenser collar thread |
| 23 | Outer container thread |
| 24 | Inner container collar connect |
| 25 | Inner container collar member |
| 26 | Outer container collar member ridge |
| 27 | Outer container thread |
| 28 | Outer container thread terminus |
| 29 | Outer container thread abutment |
| 30 | Dispenser collar thread member |
| 31 | Dispenser collar thread groove |
| 32 | Dispenser collar thread terminus |
| 33 | Dispenser collar thread abutment |
| 34 | First seal or coupling / barrier (outer container / inner container collar) |
| 35 | Second seal (i.e., an air-tight seal) (inner container collar / dispenser collar); can be a valve-seal or compression-seal (e.g., liner/gasket seal) |
| 36 | Third seal or coupling / barrier (dispenser collar / lid) |
| 37 | Inner container |
| 38 | Vent |
| 39 | Fourth seal (i.e., an air-tight seal) (dispenser / dispenser collar); can be a compression-seal (e.g., gasket seal) |

The foregoing aspects and many of the attendant advantages of this disclosure will become more readily appreciated as the same become better understood by reference to the following detailed description, when taken in conjunction with the accompanying drawings.

DETAILED DESCRIPTION

Retinol is useful in the cosmetics industry as an anti-aging compound, but is oxygen-sensitive and photo-sensitive. Exposure of retinol to air causes chemical changes to retinol that reduce its effectiveness in cosmetics applications.

Previous containers intended for reduction of exposure of oxygen/moisture sensitive formulas to air do not effectively extend the shelf life of these compositions. These previous containers are either single-container design or double-container design, in which inner flexible containers that store the cosmetic compositions therein are affixed to rigid outer containers that provide support for the overall container assembly. With these previous double-containers, dispensers are typically connected to the inner flexible containers directly, and are secured with a shared or integrated collar design. This direct connection between dispensers and inner containers does not adequately protect the retinol from the outside air, at least due to the presence of a lower number of seals (e.g., only one seal, formed between a dispenser and an inner container, that may be less than air-tight). As a result, the shelf life of retinol-containing compositions are limited due to use of these previous containers.

Accordingly, there is a need for improved container assemblies for airtight storage and delivery of retinol and retinol-containing cosmetic compositions, which protect the retinol from air and extend the shelf life of these compositions. The present disclosure addresses these and other long-felt and unmet needs in the art.

In various aspects, the disclosure provides collared containers for airtight storage and delivery of retinol-containing cosmetic compositions. The collared containers include a plurality of seals or barriers for improved insulation of retinol from the outside air. The collared containers include a "double-container" design aspect that comprises multiple layers of barrier materials, including an outer container that is made of a thick-walled high barrier material. The double-container aspect of the disclosure effectively lengthens the shelf life of sensitive formulas. For assembly of a collared container of the disclosure, an inner container is assembled onto an outer container first, then a dispensing unit is connected. This sequence of construction of the collared container helps ensure that refilling the container with a formula, e.g., a retinol composition, is easier.

As used herein, the term "seal" refers generally to air-tight seals and seals (or barriers) that are not air-tight. As used herein, the term "air-tight" and similar terms with reference to a particular seal, refer to the property of seal as being able to fully prevent the flow of fluids, including gases and liquids, therethrough.

The collared containers can be rechargeable or refillable, or alternatively, can be non-rechargeable or non-refillable. Example structural elements, as disclosed herein, enable use of a particular collared container as rechargeable or non-rechargeable, as the case may be.

As shown at FIGS. 1A-1G, a first example collared container 1 is non-rechargeable. Such a collared container 1 can be implemented for single-use retinol products intended for disposal after a single use or upon partial or complete depletion of the retinol-containing composition from the collared container 1. In these and related non-rechargeable embodiments, the collared container 1 can include one or more structural elements that are recyclable for a reduced or eliminated environmental footprint. In at least some embodiments, all structural elements of the collared container 1 are recyclable.

Figure 1B:
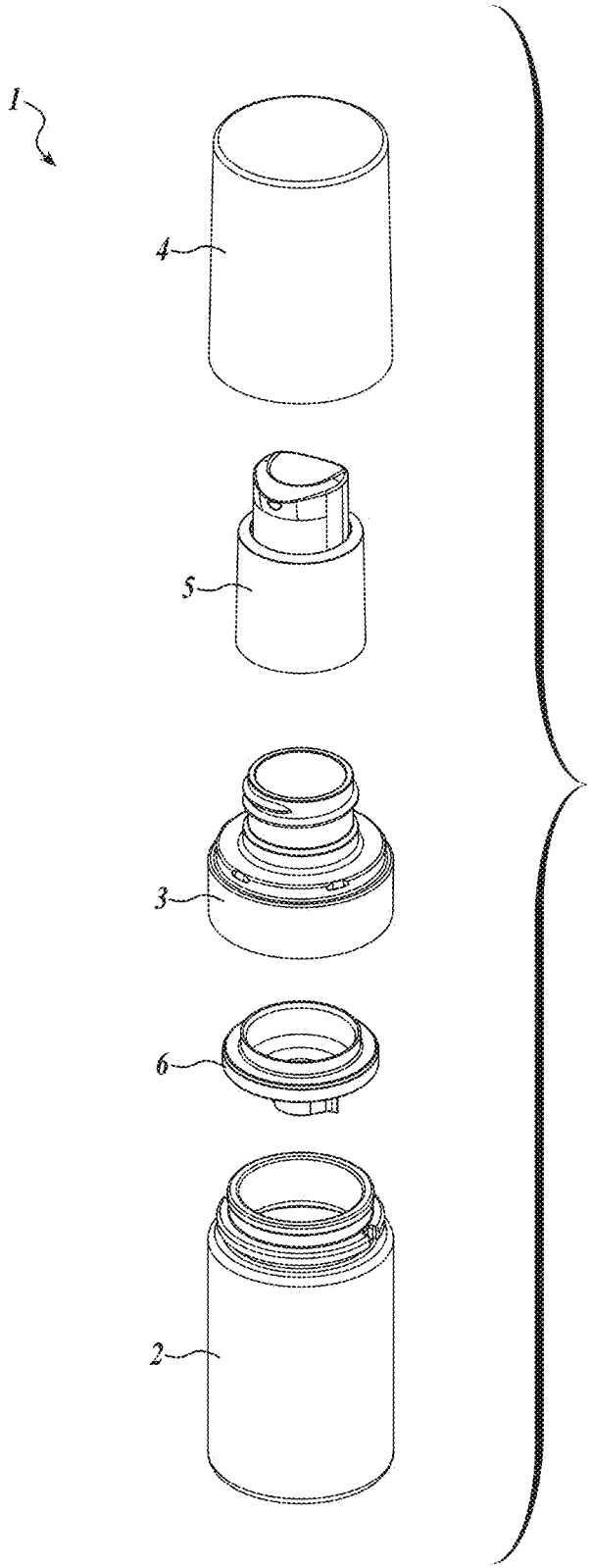
FIG. 1B shows an exploded perspective view of the first example collared container, according to aspects of the disclosure.

As shown at FIG. 1A, the first example collared container 1 that is non-rechargeable is shown in a closed configuration, with a lid 4 connected to a dispenser collar 3 which is connected to an outer container 2. FIG. 1B shows an exploded perspective view of the first example collared container 1, showing the lid 4, the outer container 2, and the dispenser collar 3, as well as an inner container collar 6 and a dispenser 5.

During assembly of the first example collared container 1, the inner container collar 6 is connected (or has been previously connected) to an inner container (e.g., inner container 7 of FIG. 1C), and the inner container collar 6 is snap-connected to the outer container 2 such that the inner container is within an interior of the outer container 2. Then, the dispenser 5 is positioned for dispensing of a cosmetic composition from an interior of the inner container, e.g., by insertion of a straw of the dispenser 5 into the interior of the inner container. This is to configure the container for pumping of the cosmetic composition from the interior of the inner container to an interior of the dispenser 5 for delivery to a surface, such as a portion of a subject's skin or a cosmetic article such as a swab, cloth, or the like, for application to the portion of the subject's skin. Then, the dispenser collar 3 is placed over the dispenser 5 and is snap-connected to the outer container 2 for a direct connection between the dispenser collar 3 and the outer container 2 and securement of the dispenser 5 to the outer container 2.

Figure 1C:
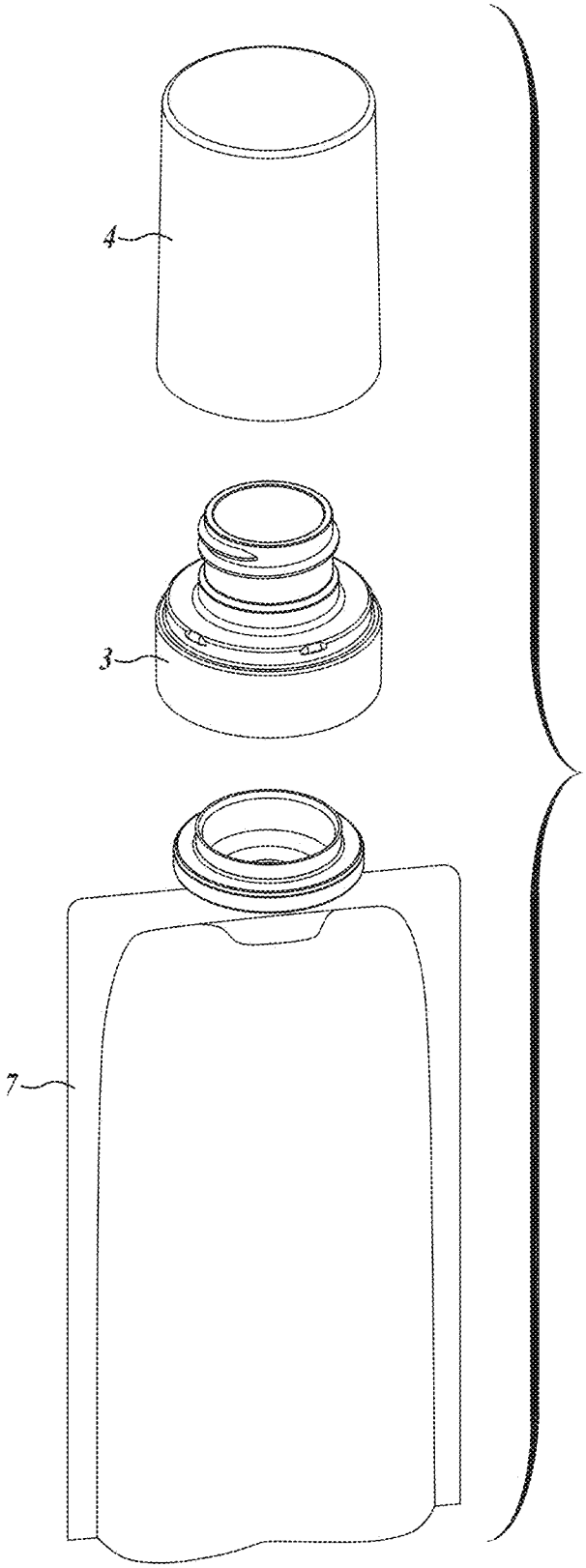
FIG. 1C shows an exploded perspective view of an inner container, dispenser collar, and lid, arranged for assembly, according to aspects of the disclosure.

As such, in embodiments, the dispenser collar 3 is not directly connected to the inner container. Furthermore, in embodiments, dispenser 5 can include an internal mechanism configured to sustain an air-tight seal between the interior of the inner container and the exterior of the collared container 1. In addition, the inner container 7 shown at FIG. 1C is a flexible pouch, however, other types of inner containers can be implemented in embodiments without departing from the scope and spirit of the disclosure; these include, for example, a flexible blow mold bottle, a rigid container that includes a piston, and the like.

Then, the lid 4 can be snap-connected to the dispenser collar 3 and the closed configuration of FIG. 1A formed. In the closed configuration of FIG. 1A, and in a use configuration (e.g., the use configuration formed by removal of lid 4 for use of the collared container 1), a plurality of seals or barriers, including at least one air-tight seal, effectively insulates the interior of the inner container from the air outside the collared container 1 and prevents exposure of the cosmetic composition within the interior container to air, preventing breakdown of retinol within the cosmetic composition and extending the shelf life of the cosmetic composition.

Figure 1D:
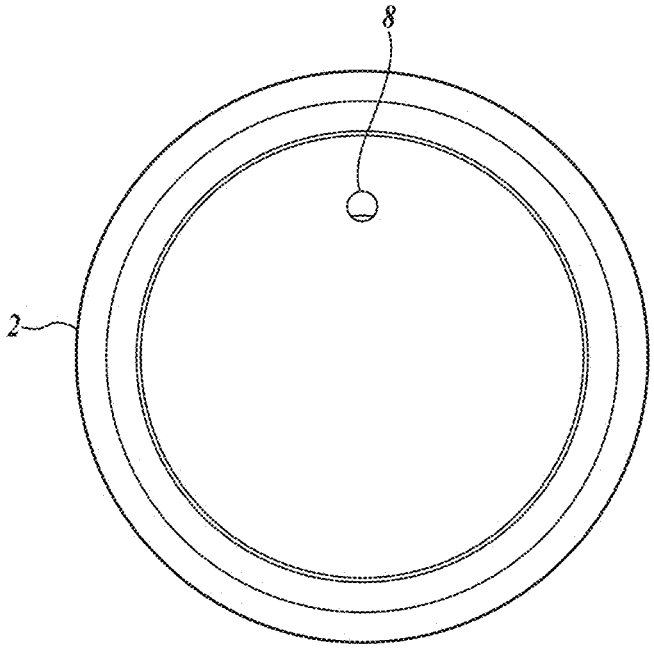
FIG. 1D shows a bottom plan view of an outer container of the first example collared container that is non-rechargeable, according to aspects of the disclosure.

As shown at FIG. 1D, an outer container 2 of the first example collared container includes a vent 8, which in the shown embodiment is positioned at a bottom of the outer container 2. As such, in various embodiments, the outer container 2 comprises a rigid material and the vent 8 is positioned at a bottom of the outer container 2. Any of various rigid materials can be implemented for the rigid material of the outer container 2, including but not limited to glass, metal, alloy, plastic, heavy-wall plastic, and the like. While placement of the vent 8 can be made at any location on the outer container 2, such as on a sidewall of the outer container 2, in example embodiments, the vent 8 is placed on the bottom of the outer container 2. In this manner, as the container is placed on a surface in an upright orientation, the vent 8 is adjacent to or contacts the surface. With storage of the container in this manner, little or no air is able to passively diffuse through the vent 8 for a reduced risk of the cosmetic composition becoming exposed to air as a result.

Figure 1E:
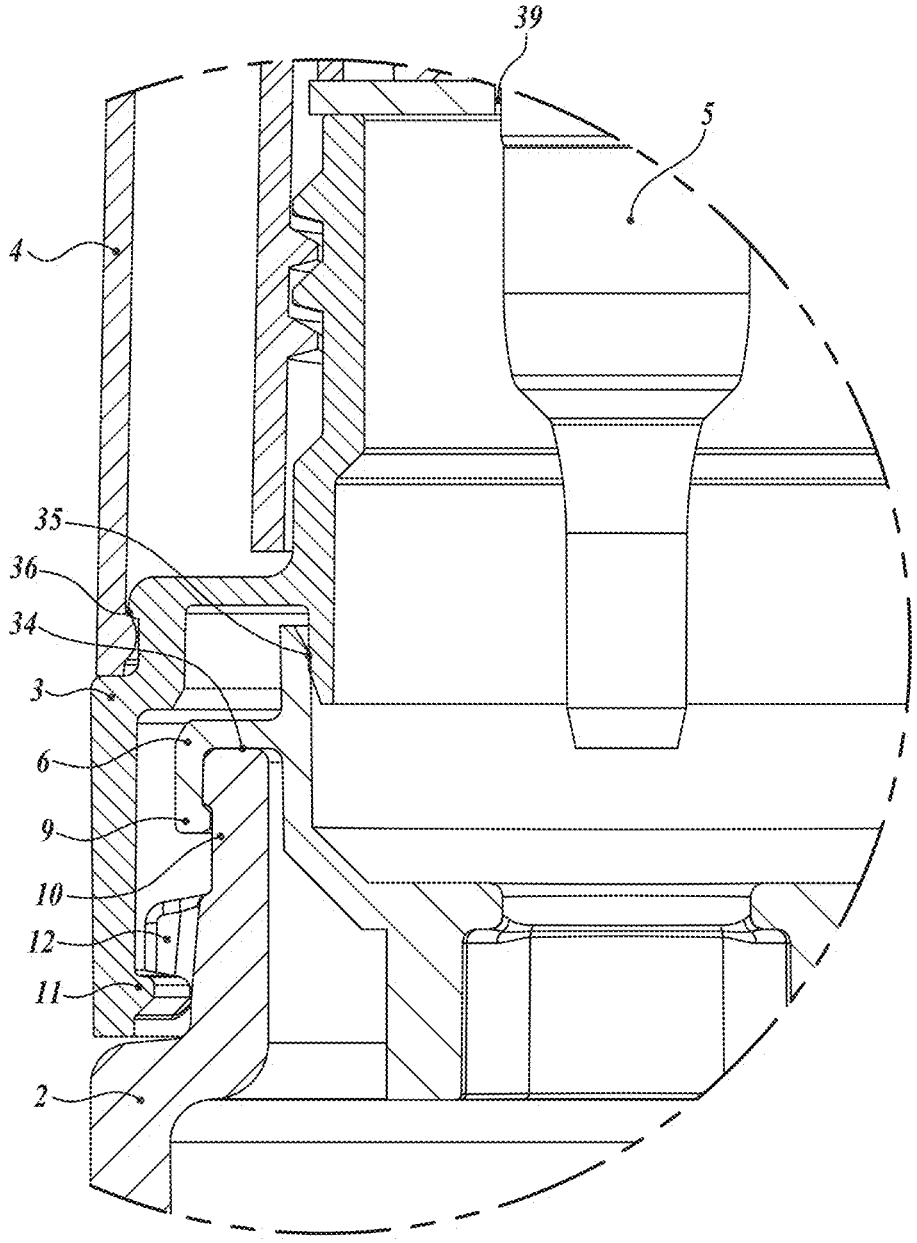
FIG. 1E shows an inset cross-sectional view of structures of the first example collared container for formation of a plurality of seals, according to aspects of the disclosure.
Figure 1F:
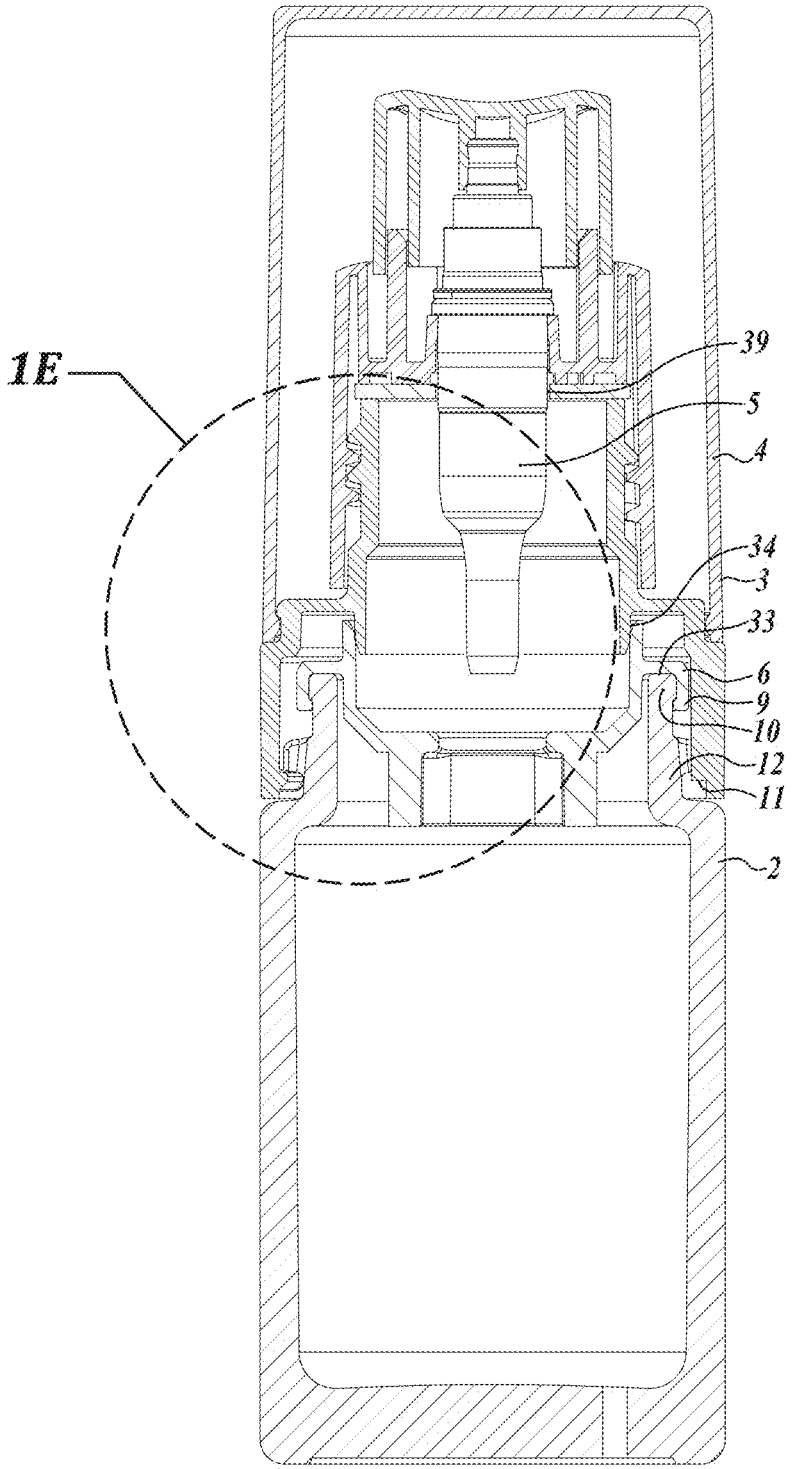
FIG. 1F shows a cross-sectional view of the first example collared container, according to aspects of the disclosure.

FIG. 1E shows an inset cross-sectional view of structures of the first example collared container for formation of a plurality of seals. FIG. 1E is an inset of FIG. 1F. In the shown example, the outer container 2 comprises an upper aperture that fluidly connects an interior of the outer container 2 to an exterior of the outer container. The collared container includes an inner container that is securable within the interior of the outer container 2 via a first snap fit connection between an inner container collar 6 and the outer container 2 (e.g., forming a first seal 34), as well as a dispenser 5 that is securable to the outer container 2 via a second snap fit connection between a dispenser collar 3 and the outer container 2 (e.g., forming a second seal 35), and a lid 4 that is securable to the dispenser collar 3. In the shown embodiment, securement of the first (between the inner container collar 6 and the outer container 2) and second (between the dispenser collar 3 and the outer container 2) snap fit connections forms at least part of a plurality of seals for prevention of gas flow from the exterior of the outer container 2 to an interior of the inner container. In the shown embodiment, securement of the lid 4 to the dispenser collar 3 forms a seal (e.g., third seal 36) of the at least part of the plurality of seals for prevention of gas flow from the exterior of the outer container 2 to the interior of the inner container. In this manner, the cosmetic substance within the interior of the inner container is protected from contact with air.

In the shown embodiment, a first seal 34 of the plurality of seals is formed between the outer container 2 and the inner container collar 6, a second seal 35 of the plurality of seals is formed between the inner container collar 6 and the dispenser collar 3, and a third seal 36 of the plurality of seals is formed between the dispenser collar 3 and the lid 4. While three seals (34, 35, 36) are implemented in the shown embodiment, alternate numbers of seals, including two, four, five, six, seven, eight, nine, ten, or more seals can be implemented in other embodiments. Thus, a plurality of seals of the disclosure provides a more airtight storage and delivery of the cosmetic substance as compared with previous efforts.

In the shown embodiment, the first and second snap fit connections (i.e., a first snap fit connection between the outer container 2 and the inner container collar 6, and a second snap fit connection between the outer container 2 and the dispenser collar 3) are annular snap fit connections. As used herein, an "annular snap fit connection" refers to any snap fit connection that extends circumferentially (e.g., partially, intermittently, or completely) around a circular portion of the collared container. While annular snap fit connections enable an effective seal in the disclosed example embodiments, alternate snap fit connections can be implemented in other embodiments without departing from the scope and spirit of the disclosure, including but not necessarily limited to: an alternate annular snap fit connection, a cantilever snap fit connection, and a torsional snap fit connection.

Figure 1G:
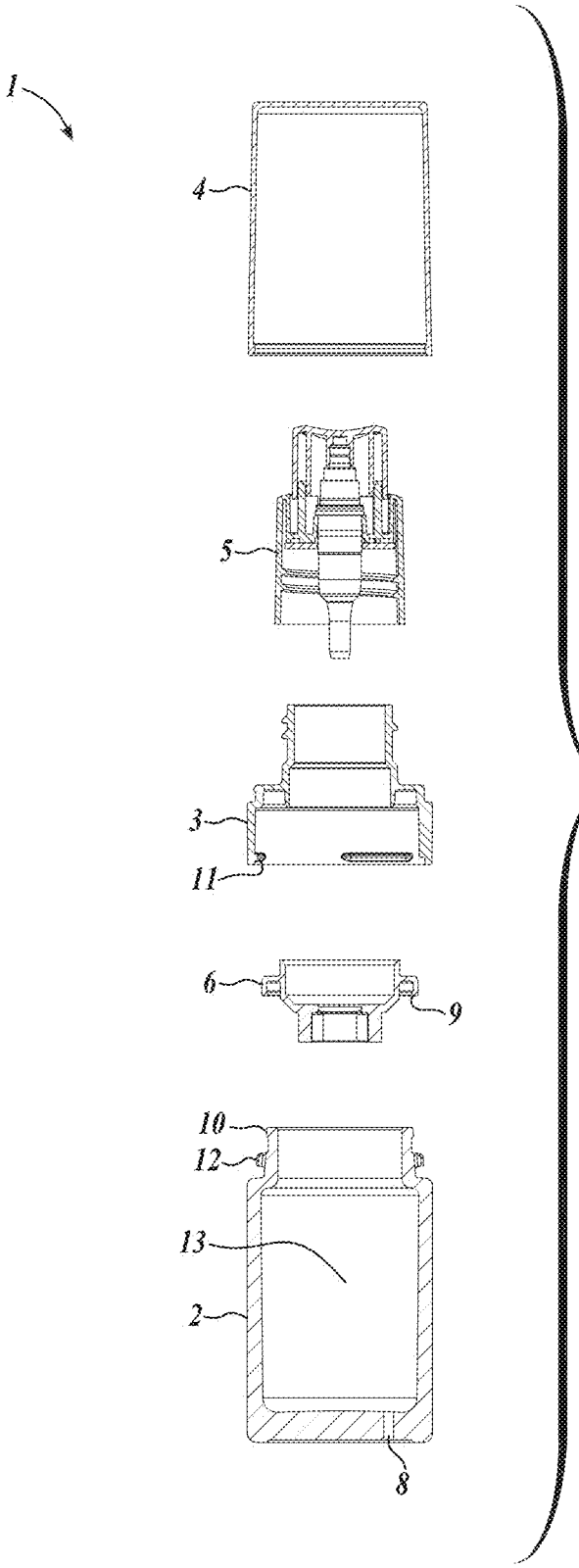
FIG. 1G shows an exploded cross-sectional view of the first example collared container, according to aspects of the disclosure.

FIG. 1G shows an exploded cross-sectional view of the first example collared container. For assembly of the first example collared container 1, the inner container collar 6 is attached to the outer container 2 prior to attachment of the dispenser collar 3 to the outer container 2, and the dispenser collar 3 is attached to the outer container 2 prior to attachment of the lid 4 to the dispenser collar 3. In this manner, at least part of the plurality of seals are formed and maintained. In the shown example snap fit connections, snap fit connections occur between inner container collar snap fit outer 9 and inner container collar snap fit inner 10, between outer container collar snap fit outer 11 and outer container collar snap fit inner 12, and between the lid 4 and the dispenser collar 3 (e.g., forming seal 36 of FIG. 1E). Prior to assembly of the collared container 1, an interior 13 of the outer container 2 is fluidly connected to an exterior space (e.g., air) of the outer container 2 via an outer container vent 8 and an upper aperture of the outer container 2, i.e., the upper opening of the outer container 2 at which the inner container collar 6 is attached, formed by an outer container lip (e.g., outer container lip 21 of FIG. 2F).

In embodiments, the dispenser 5 is an airless pump, such as a piston pump or a plunger pump, however, any suitable airless pump dispenser can be used for the dispenser 5 without departing from the scope and spirit of the disclosure. In example embodiments, the outer container 2 is comprised of glass or a glass material, however, in other embodiments, the outer container 2 is comprised of a plastic or other polymer material.

As shown at FIGS. 2A-2F, a second example collared container 14 is rechargeable. Such a collared container 14 can be implemented for multiple-use retinol products intended for disposal after multiple uses or upon partial or complete depletion of the retinol-containing composition from the collared container 14. In these and related rechargeable embodiments, the collared container 14 can include one or more structural elements that are recyclable for a reduced or eliminated environment footprint. In at least some embodiments, all structural elements of the collared container 14 are recyclable.

Figure 2A:
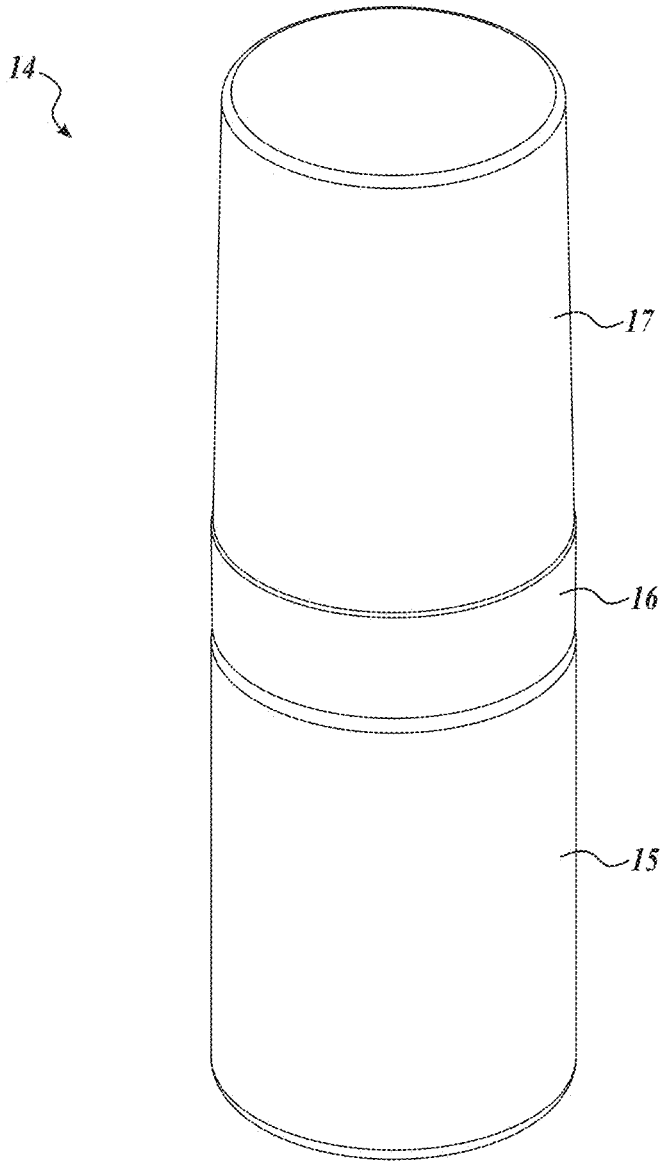
FIG. 2A shows a perspective view of a second example collared container that is rechargeable, according to aspects of the disclosure.
Figure 2B:
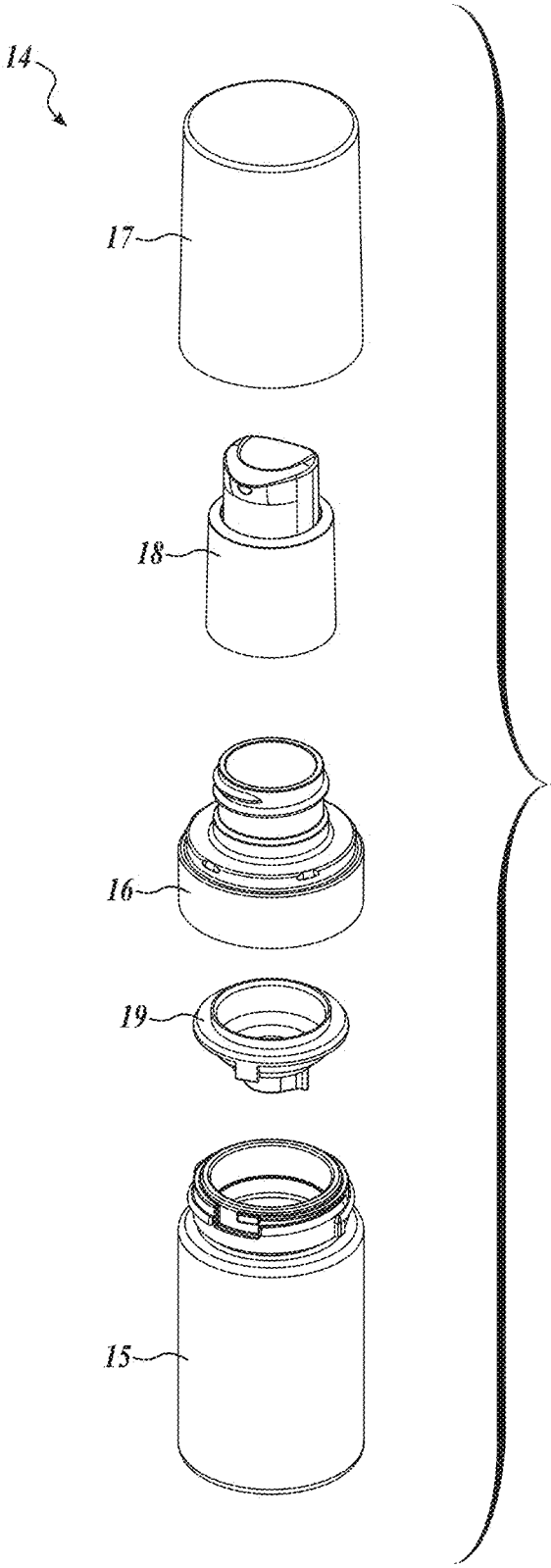
FIG. 2B shows an exploded perspective view of an outer container, inner container collar, dispenser collar, lid, dispenser, and inner container collar of the second example collared container that is rechargeable, according to aspects of the disclosure.

As shown at FIG. 2A, the second example collared container 14 that is rechargeable is shown in a closed configuration, with a lid 17 connected to a dispenser collar 16 which is connected to an outer container 15. FIG. 2B shows an exploded perspective view of the second example collared container 14, showing the lid 17, the outer container 15, and the dispenser collar 16, as well as an inner container collar 19 and a dispenser 18.

During assembly of the second example collared container 14, the inner container collar 19 is connected to an inner container (e.g., inner container 37 of FIG. 2C), and the inner container collar 19 is connected to the outer container 15 such that the inner container is within an interior of the outer container 15. Then, the dispenser 18 is positioned for dispensing of a cosmetic composition from an interior of the inner container, e.g., by insertion of a straw of the dispenser 18 into the interior of the inner container. This is to configure the container for pumping of the cosmetic composition from the interior of the inner container to an interior of the dispenser 18 for delivery to a surface, such as a portion of a subject's skin or a cosmetic article such as a swab, cloth, or the like, for application to the portion of the subject's skin. Then, the dispenser collar 16 is placed over the dispenser 18 and is connected to the outer container 15 for a direct connection between the dispenser collar 16 and the outer container 15 and securement of the dispenser 18 to the outer container 15.

Figure 2C:
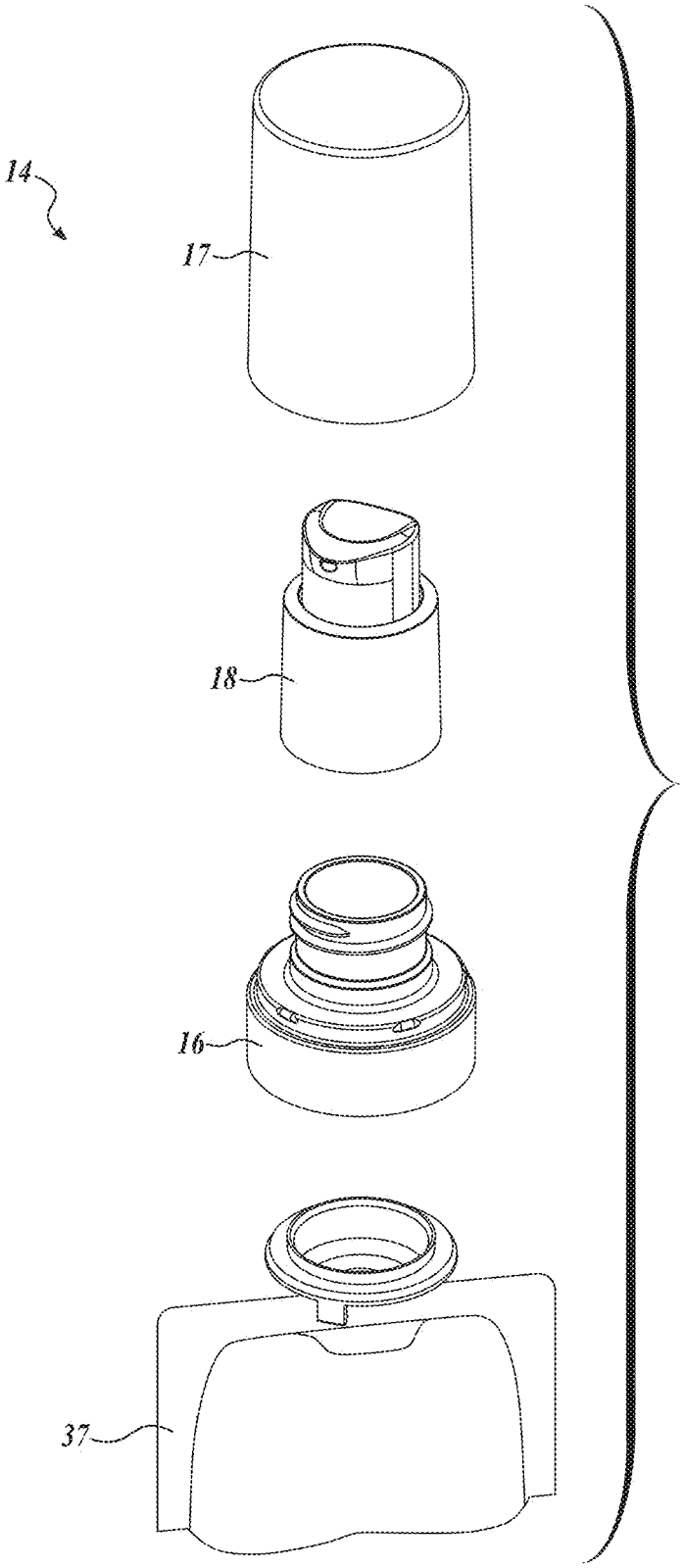
FIG. 2C shows an exploded perspective view of a dispenser collar, lid, dispenser, and container collar thread of the second example collared container that is rechargeable, according to aspects of the disclosure.

As such, in embodiments, the dispenser collar 16 is not directly connected to the inner container. Furthermore, in embodiments, dispenser 18 can include an internal mechanism configured to sustain an air-tight seal between the interior of the inner container and the exterior of the collared container 14. In addition, the inner container 37 shown at FIG. 2C is a flexible pouch, however, other types of inner containers can be implemented in embodiments without departing from the scope and spirit of the disclosure; these include, for example, a flexible blow mold bottle, a rigid container that includes a piston, and the like.

Then, the lid 17 can be connected to the dispenser collar 16 and the closed configuration of FIG. 2A formed. In the closed configuration of FIG. 2A, and in a use configuration (e.g., the use configuration formed by removal of lid 17 for use of the collared container 14), a plurality of seals effectively insulates the interior of the inner container from the air outside the collared container 14 and prevents exposure of the cosmetic composition within the interior container to air, preventing breakdown of retinol within the cosmetic composition and extending the shelf life of the cosmetic composition.

Figure 2D:
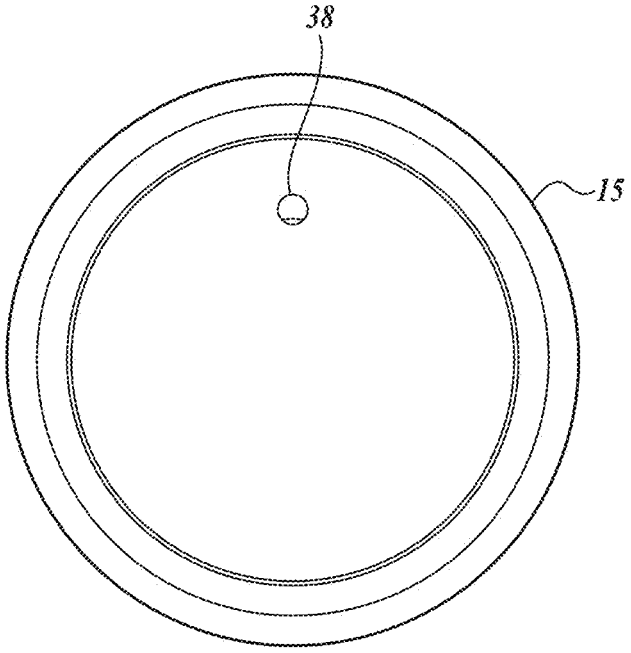
FIG. 2D shows a bottom plan view of an outer container of the second example collared container that is rechargeable, according to aspects of the disclosure.

As shown at FIG. 2D, an outer container 15 of the first example collared container includes a vent 16, which in the shown embodiment is positioned at a bottom of the outer container 15. As such, in various embodiments, the outer container 15 comprises a rigid material and the vent 16 is positioned at a bottom of the outer container 15. Any of various rigid materials can be implemented for the rigid material of the outer container 15, including but not limited to glass, metal, alloy, plastic, heavy-wall plastic, and the like. While placement of the vent 16 can be made at any location on the outer container 15, such as on a sidewall of the outer container 15, in example embodiments, the vent 16 is placed on the bottom of the outer container 15. In this manner, as the container is placed on a surface in an upright orientation, the vent 16 is adjacent to or contacts the surface. With storage of the container in this manner, little or no air is able to passively diffuse through the vent 16 for a reduced risk of the cosmetic composition becoming exposed to air as a result.

Figure 2E:
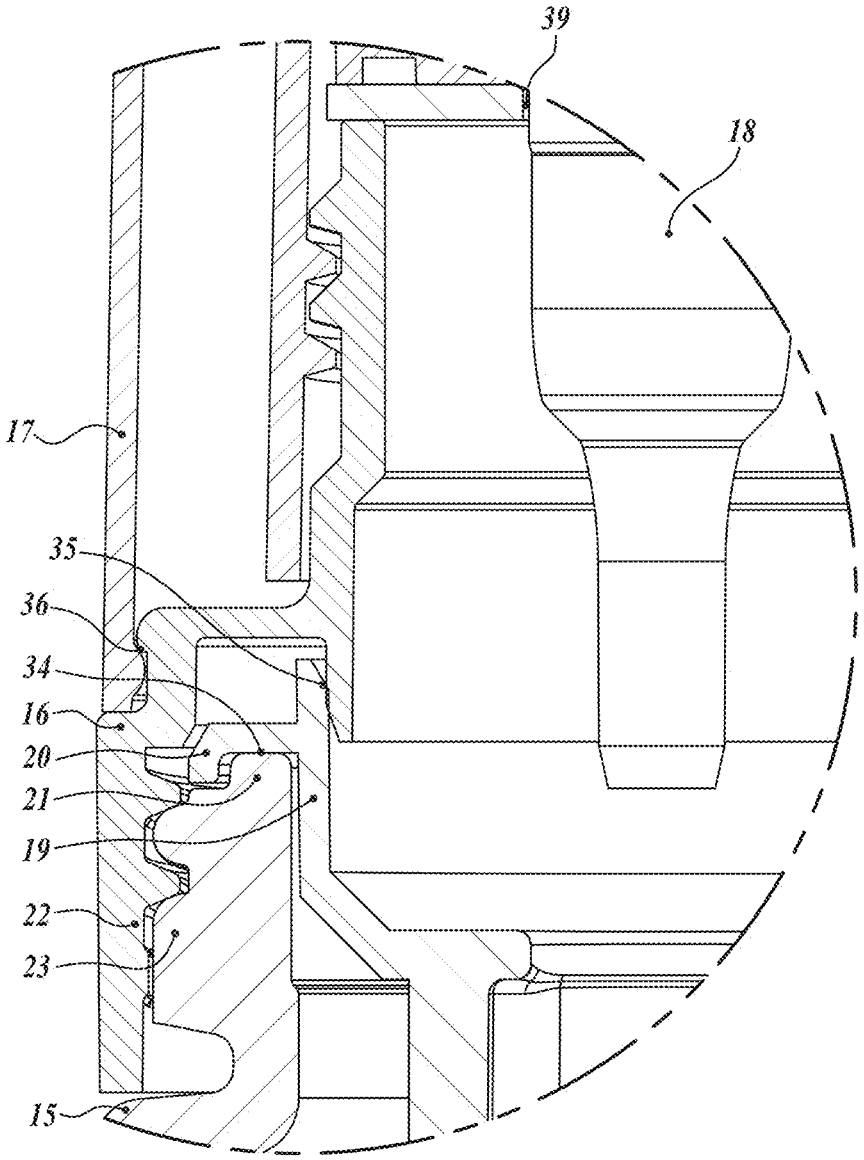
FIG. 2E shows an inset cross-sectional view of structures of the second example collared container for formation of a plurality of seals, according to aspects of the disclosure.
Figure 2F:
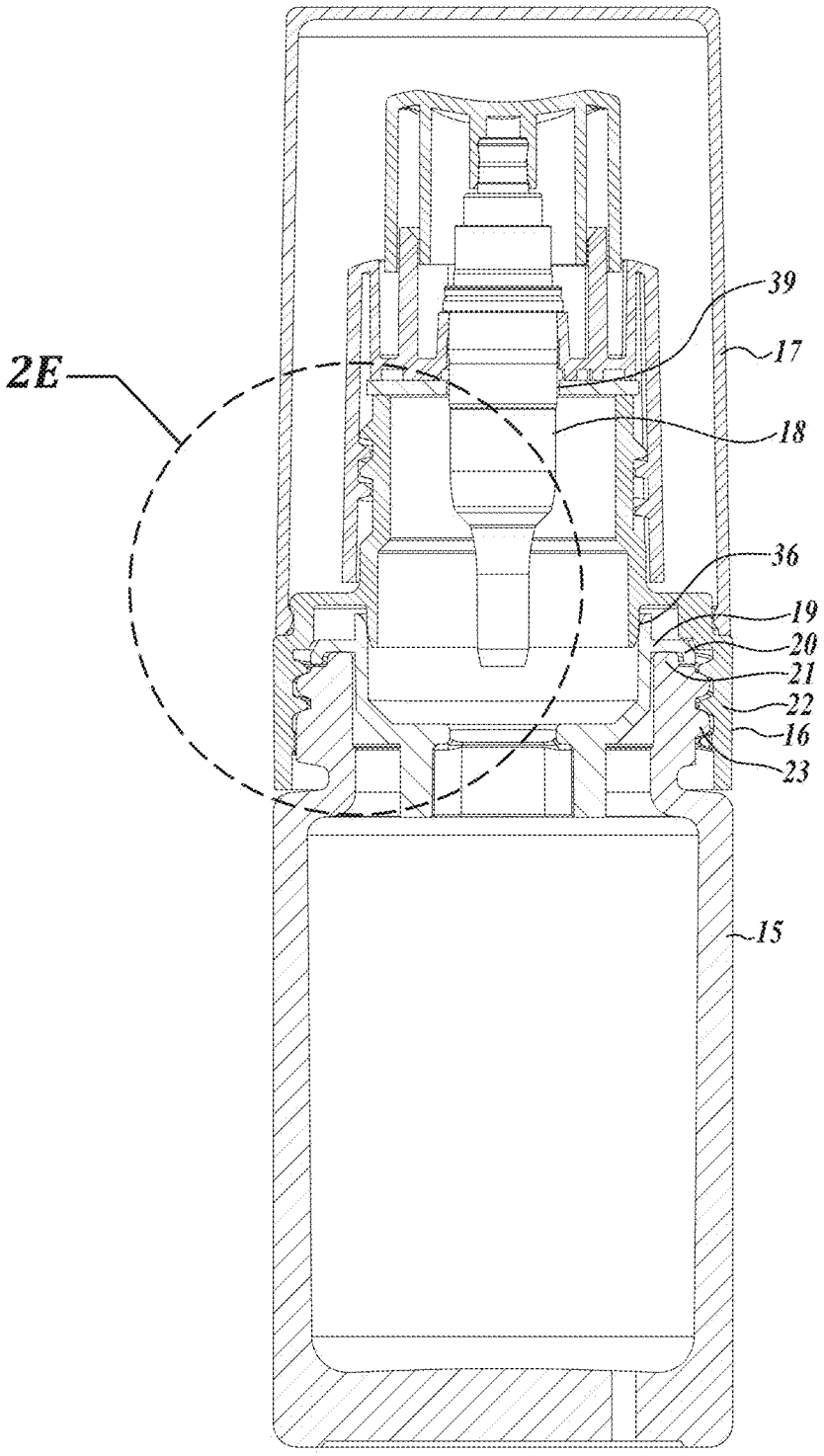
FIG. 2F shows a cross-sectional view of the second example collared container, according to aspects of the disclosure.

FIG. 2E shows an inset cross-sectional view of structures of the second example collared container for formation of a plurality of seals. FIG. 2E is an inset of FIG. 2F. In the shown example, the outer container 15 comprises an upper aperture that fluidly connects an interior of the outer container 15 to an exterior of the outer container. The collared container includes an inner container that is securable within the interior of the outer container 15 via a first lockable threaded connection between an inner container collar 19 and the outer container 15 (e.g., forming a first seal 34), as well as a dispenser 18 that is securable to the outer container 15 via a second lockable threaded connection between a dispenser collar 16 and the outer container 15 (e.g., forming a second seal 35), and a lid 17 that is securable to the dispenser collar 16. In the shown embodiment, securement of the first (between the inner container collar 19 and the outer container 15) and second (between the dispenser collar 16 and the outer container 15) lockable threaded connections forms at least part of a plurality of seals for prevention of gas flow from the exterior of the outer container 15 to an interior of the inner container. In the shown embodiment, securement of the lid 17 to the dispenser collar 16 forms a seal (e.g., third seal 36) of the at least part of the plurality of seals for prevention of gas flow from the exterior of the outer container 15 to the interior of the inner container. In this manner, the cosmetic substance within the interior of the inner container is protected from contact with air.

In the shown embodiment, a first seal 34 of the plurality of seals is formed between the outer container 15 and the inner container collar 19, a second seal 35 of the plurality of seals is formed between the inner container collar 19 and the dispenser collar 16, and a third seal 36 of the plurality of seals is formed between the dispenser collar 16 and the lid 17. While three seals (34, 35, 36) are implemented in the shown embodiment, alternate numbers of seals, including two, four, five, six, seven, eight, nine, ten, or more seals can be implemented in other embodiments. Thus, a plurality of seals of the disclosure provides a more airtight storage and delivery of the cosmetic substance as compared with previous efforts.

In the shown embodiment, first and second lockable threaded connections (i.e., a first lockable threaded connection between the outer container 15 and the inner container collar 19, and a second lockable threaded connection between the outer container 15 and the dispenser collar 16) are able to be formed. As used herein, a "lockable threaded connection" refers to any threaded connection that is reversibly lockable, including as disclosed herein by way of non-limiting examples. While the disclosed lockable threaded connections enable an effective seal in the disclosed example embodiments, alternate lockable threaded connections can be implemented in other embodiments without departing from the scope and spirit of the disclosure.

For assembly of the second example collared container 14, the inner container collar 19 is attached to the outer container 15 prior to attachment of the dispenser collar 16 to the outer container 15, and the dispenser collar 16 is attached to the outer container 15 prior to attachment of the lid 17 to the dispenser collar 16. In this manner, at least part of the plurality of seals are formed and maintained.

In the shown example, lockable threaded connections occur between inner container collar thread 20 and outer container lip 21, between dispenser collar thread 22 and outer container thread 23, and can occur between the lid 17 and the dispenser collar 16 (e.g., forming seal 36 of FIG. 1E); alternatively, a snap fit connection can occur between the lid 17 and the dispenser collar 16 (e.g., forming seal 36 of FIG. 1E). Prior to assembly of the collared container 14, an interior of the outer container 15 is fluidly connected to an exterior space (e.g., air) of the outer container 15 via an outer container vent (e.g., vent 16 of FIG. 2D) and an upper aperture of the outer container 15, i.e., the upper opening of the outer container 15 at which the inner container collar 19 is attached, formed by an outer container lip (e.g., outer container lip 21 of FIG. 2F).

In embodiments, the dispenser 18 is an airless pump, such as a piston pump or a plunger pump, however, any suitable airless pump dispenser can be used for the dispenser 18 without departing from the scope and spirit of the disclosure. In example embodiments, the outer container 15 is comprised of glass or a glass material, however, in other embodiments, the outer container 15 is comprised of a plastic or other polymer material.

FIGS. 3A-3D show several views of example connections among the outer container 15, the dispenser collar 16, and the inner container collar 19. During assembly of an example collared container, an inner container can be coupled to the inner container collar 19 at an inner container collar connect 24, prior to attachment of the inner container collar 19 to the outer container 15.

Figure 3A:
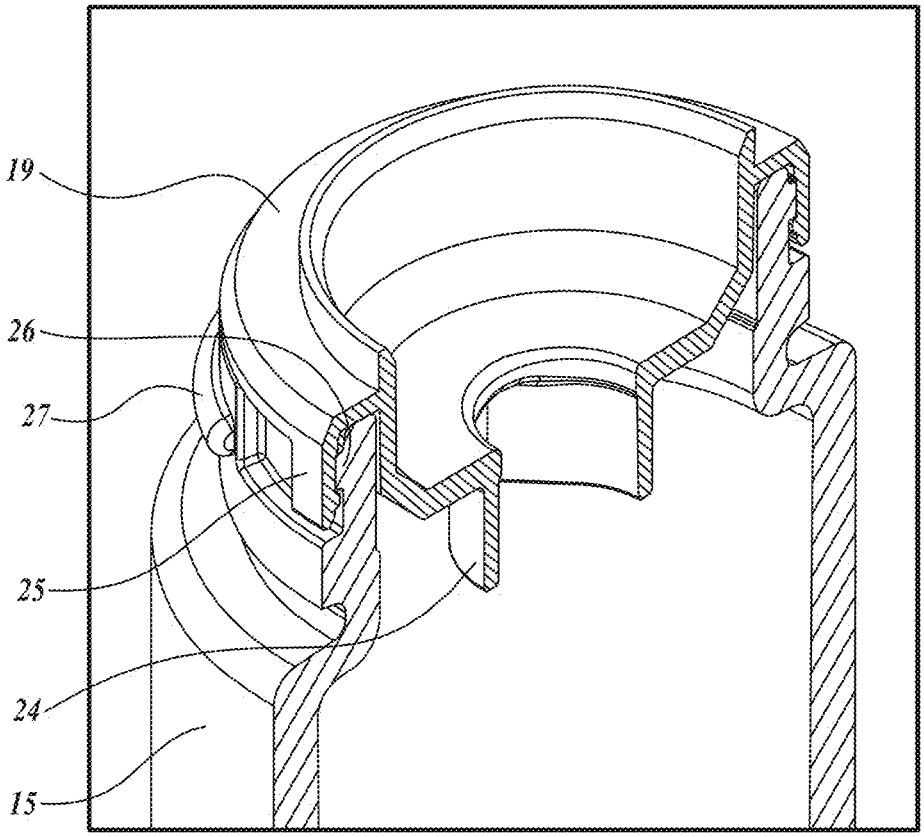
FIG. 3A shows a perspective cutaway view of an outer container and an inner container collar of the second example collared container, according to aspects of the disclosure.
Figure 3B:
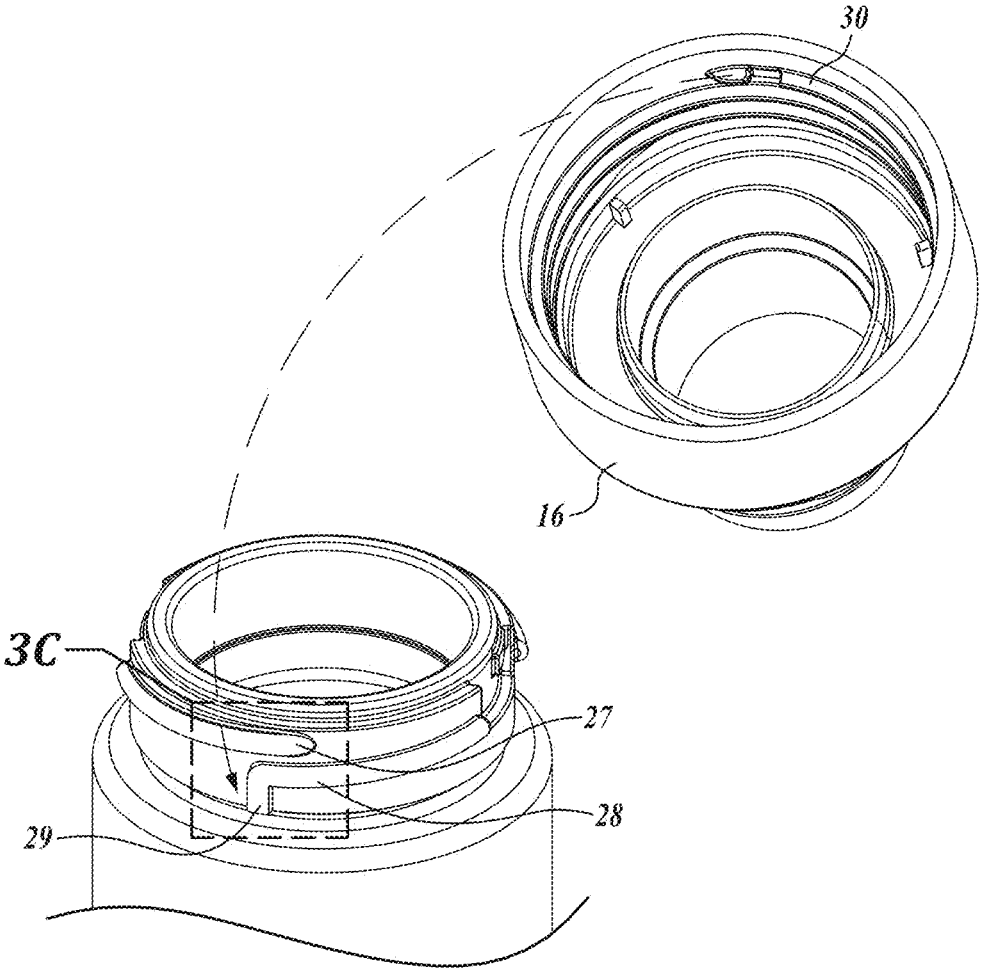
FIG. 3B shows a perspective view of the outer container and the inner container collar of the second example collared container prior to securement therebetween, according to aspects of the disclosure.

In the shown embodiment, the first lockable threaded connection occurs between an inner container collar member 25 and an outer container collar member ridge 26. The outer container collar member ridge 26 is semi-circumferential such that the inner container collar member 25 is rotatably movable relative to the outer container collar member ridge 26 for transitions between an unlocked configuration (e.g., relative to the configuration at FIG. 3A, if the inner container collar 19 were rotated clockwise, from a top-down view, such that the inner container collar member 25 slides within a groove formed by the outer container collar member ridge 26 and is able to be vertically displaced through a gap in the outer container collar member ridge 26 for removal of the inner container collar member 25 from the outer container collar member ridge 26 and removal of the inner container collar 19 from the outer container 15) and a locked configuration (e.g., as shown at FIG. 3A, with the inner container collar member 25 secured by the outer container collar member ridge 26).

Figure 3C:
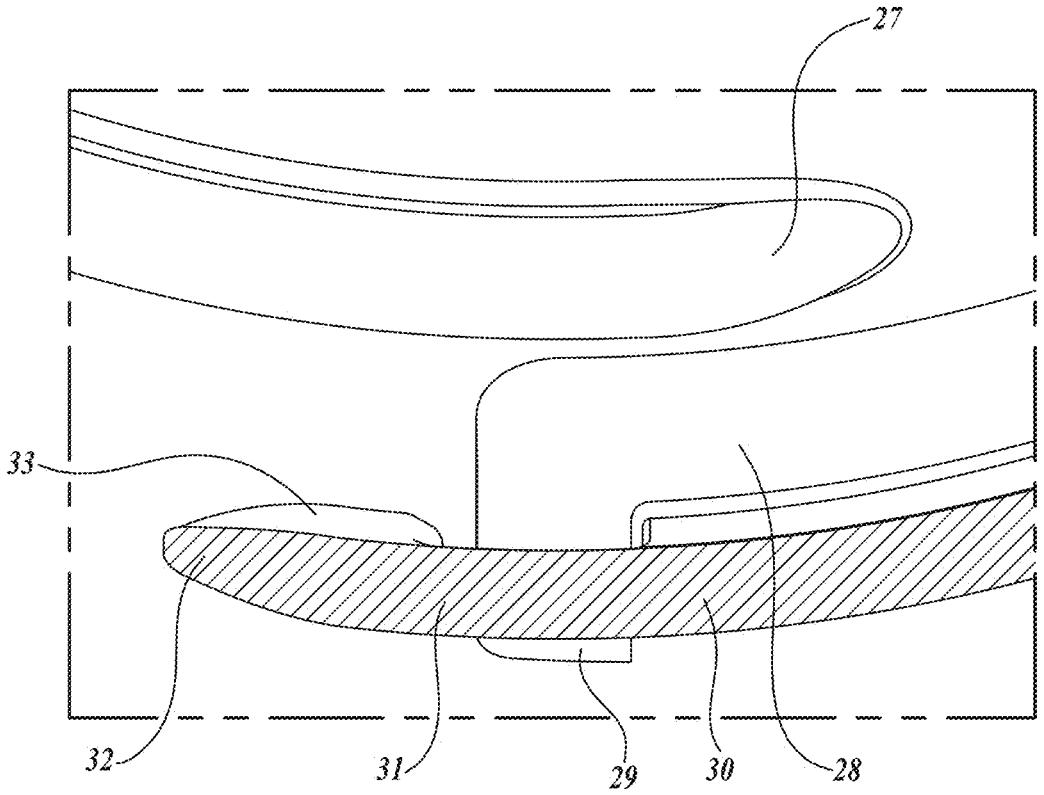
FIG. 3C shows a close-up perspective view of elements of an internal container collar thread and dispenser collar thread securement mechanism, according to aspects of the disclosure.
Figure 3D:
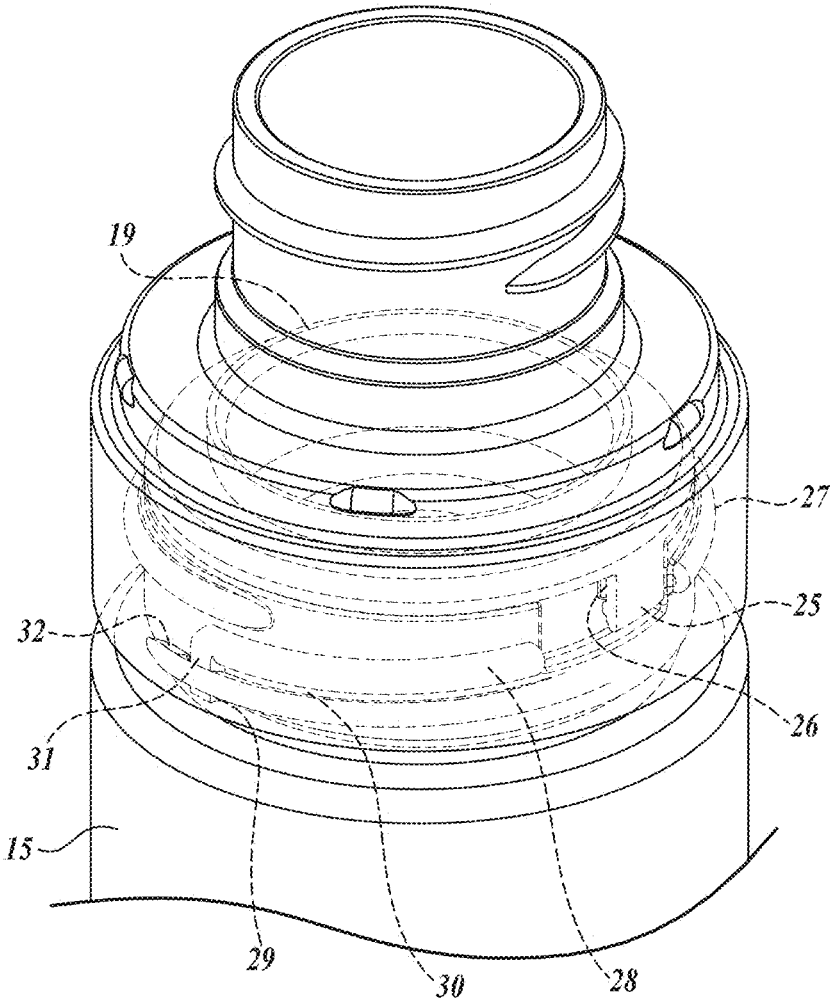
FIG. 3D shows a perspective view of the second example collared container, showing securement mechanisms, according to aspects of the disclosure.

In the shown embodiment, the second lockable threaded connection occurs between an outer container thread 27 of the outer container 15 and a dispenser collar thread (30, 31, 32, 33) of the dispenser collar 16, which occurs at an outer container thread terminus 28 of the outer container thread 27, formed by a member 30 of the dispenser collar thread that includes a groove 31 and terminates at a terminus 32 that includes an abutment 33 thereon, which can be a portion of the terminus 32 that widens in diameter relative to the dispenser collar thread groove 31. In embodiments, a first rotational movement of the dispenser collar thread (30, 31, 32, 33) about the outer container thread 27 (e.g., clockwise as viewed from above) passes the terminus 32 of the dispenser collar over an abutment 29 of the outer container thread 27 and snap-secures the abutment 29 of the outer container within the groove 31 of the dispenser collar thread to form a locked configuration (as shown at FIG. 3C). In embodiments, a second rotational movement of the dispenser collar thread (30, 31, 32, 33) about the outer container thread 27 (e.g., counter-clockwise as viewed from above) passes the terminus 32 of the dispenser collar over the abutment 29 of the outer container thread 27 and snap-releases the abutment 29 of the outer container from the groove 31 of the dispenser collar thread to form an unlocked configuration, e.g., for removal of the dispenser collar 16 from the outer container 15.

Non-Limiting Embodiments

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A non-rechargeable collared container, comprising: an outer container comprising a vent and an upper aperture that each fluidly connects an interior of the outer container to an exterior of the outer container; an inner container securable within the interior of the outer container via a first snap fit connection between an inner container collar and the outer container; a dispenser securable to the outer container via a second snap fit connection between a dispenser collar and the outer container; and a lid securable to the dispenser collar; wherein securement of the first and second snap fit connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

Embodiment 2. The non-rechargeable collared container of Embodiment 1 or any other Embodiment, wherein securement of the lid to the dispenser collar forms a seal of the at least part of the plurality of seals for prevention of gas flow from the exterior of the outer container to the interior of the inner container and preservation of the cosmetic substance within the interior of the inner container.

Embodiment 3. The non-rechargeable collared container of any one of Embodiments 1-2 or any other Embodiment, wherein a first seal of the plurality of seals is formed between the outer container and the inner container collar; a second seal of the plurality of seals is formed between the inner container collar and the dispenser collar; and a third seal of the plurality of seals is formed between the dispenser collar and the lid.

Embodiment 4. The non-rechargeable collared container of any one of Embodiments 1-3 or any other Embodiment, wherein the first and second snap fit connections are annular snap fit connections.

Embodiment 5. The non-rechargeable collared container of any one of Embodiments 1-4 or any other Embodiment, wherein the outer container comprises a rigid material and the vent is positioned at a bottom of the outer container.

Embodiment 6. The non-rechargeable collared container of any one of Embodiments 1-5 or any other Embodiment, wherein the inner container collar is attached to the outer container prior to attachment of the dispenser collar to the outer container for formation of the at least part of the plurality of seals.

Embodiment 7. The non-rechargeable collared container of any one of Embodiments 1-6 or any other Embodiment, wherein the dispenser collar is attached to the outer container prior to attachment of the lid to the dispenser collar for formation of a non-airtight seal of the plurality of seals.

Embodiment 8. A rechargeable collared container, comprising: an outer container comprising a vent and an upper aperture that each fluidly connects an interior of the outer container to an exterior of the outer container; an inner container securable within the interior of the outer container via a first lockable threaded connection between an inner container collar and the outer container; a dispenser securable to the outer container via a second lockable threaded connection between a dispenser collar and the outer container; and a lid securable to the dispenser collar; wherein securement of the first and second lockable threaded connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

Embodiment 9. The rechargeable collared container of Embodiment 8 or any other Embodiment, wherein securement of the lid to the dispenser collar forms a seal of the at least part of the plurality of seals for prevention of gas flow from the exterior of the outer container to the interior of the inner container and preservation of the cosmetic substance within the interior of the inner container.

Embodiment 10. The rechargeable collared container of any one of Embodiments 8-9 or any other Embodiment, wherein a first seal of the plurality of seals is formed between the outer container and the inner container collar; a second seal of the plurality of seals is formed between the inner container collar and the dispenser collar; and a third seal of the plurality of seals is formed between the dispenser collar and the lid.

Embodiment 11. The rechargeable collared container of any one of Embodiments 8-10 or any other Embodiment, wherein the outer container comprises a rigid material and the vent is positioned at a bottom of the outer container.

Embodiment 12. The rechargeable collared container of any one of Embodiments 8-11 or any other Embodiment, wherein the inner container collar is attached to the outer container prior to attachment of the dispenser collar to the outer container for formation of the at least part of the plurality of seals.

Embodiment 13. The rechargeable collared container of any one of Embodiments 8-12 or any other Embodiment, wherein the dispenser collar is attached to the outer container prior to attachment of the lid to the dispenser collar for formation of a non-airtight seal of the plurality of seals.

Embodiment 14. The rechargeable collared container of any one of Embodiments 8-13 or any other Embodiment, wherein the first lockable threaded connection occurs between an inner container collar member and an outer container collar member ridge, wherein the outer container collar member ridge is semi-circumferential such that the inner container collar member is rotatably movable relative to the outer container collar member ridge for transitions between an unlocked configuration and a locked configuration.

Embodiment 15. The rechargeable collared container of any one of Embodiments 8-14 or any other Embodiment, wherein the second lockable threaded connection occurs between an outer container thread and a dispenser collar thread, wherein: a first rotational movement of the dispenser collar thread about the outer container thread passes a terminus of the dispenser collar over an abutment of the outer container thread and snap-secures the abutment of the outer container within a groove of the dispenser collar thread to form a locked configuration; and a second rotational movement of the dispenser collar thread about the outer container thread passes the terminus of the dispenser collar over the abutment of the outer container thread and snap-releases the abutment of the outer container from the groove of the dispenser collar thread to form an unlocked configuration.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A rechargeable collared container, comprising:

an outer container comprising a vent and an upper aperture that each fluidly connects an interior of the outer container to an exterior of the outer container;

an inner container securable within the interior of the outer container via a first lockable threaded connection between an inner container collar and the outer container;

a dispenser securable to the outer container via a second lockable threaded connection between a dispenser collar and the outer container; and a lid securable to the dispenser collar;

wherein the first lockable threaded connection occurs between an inner container collar member and an outer container collar member ridge, wherein the outer container collar member ridge is semi-circumferential such that the inner container collar member is rotatably movable relative to the outer container collar member ridge for transitions between an unlocked configuration and a locked configuration; and wherein securement of the first and second lockable threaded connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

2. The rechargeable collared container of claim 1, wherein securement of the lid to the dispenser collar forms a seal of the at least part of the plurality of seals for prevention of gas flow from the exterior of the outer container to the interior of the inner container and preservation of the cosmetic substance within the interior of the inner container.

3. The rechargeable collared container of claim 1, wherein a first seal of the plurality of seals is formed between the outer container and the inner container collar; a second seal of the plurality of seals is formed between the inner container collar and the dispenser collar; and a third seal of the plurality of seals is formed between the dispenser collar and the lid.

4. The rechargeable collared container of claim 1, wherein the outer container comprises a rigid material and the vent is positioned at a bottom of the outer container.

5. The rechargeable collared container of claim 1, wherein the inner container collar is attached to the outer container prior to attachment of the dispenser collar to the outer container for formation of the at least part of the plurality of seals.

6. The rechargeable collared container of claim 5, wherein the dispenser collar is attached to the outer container prior to attachment of the lid to the dispenser collar for formation of a non-airtight seal of the plurality of seals.

7. The rechargeable collared container of claim 1, wherein the second lockable threaded connection occurs between an outer container thread and a dispenser collar thread, wherein:

a first rotational movement of the dispenser collar thread about the outer container thread passes a terminus of the dispenser collar over an abutment of the outer container thread and snap-secures the abutment of the outer container within a groove of the dispenser collar thread to form a locked configuration; and a second rotational movement of the dispenser collar thread about the outer container thread passes the terminus of the dispenser collar over the abutment of the outer container thread and snap-releases the abutment of the outer container from the groove of the dispenser collar thread to form an unlocked configuration.

8. A rechargeable collared container, comprising:

an outer container comprising a vent and an upper aperture that each fluidly connects an interior of the outer container to an exterior of the outer container;

an inner container securable within the interior of the outer container via a first lockable threaded connection between an inner container collar and the outer container;

a dispenser securable to the outer container via a second lockable threaded connection between a dispenser collar and the outer container; and a lid securable to the dispenser collar;

wherein the second lockable threaded connection occurs between an outer container thread and a dispenser collar thread, wherein:

a first rotational movement of the dispenser collar thread about the outer container thread passes a terminus of the dispenser collar over an abutment of the outer container thread and snap-secures the abutment of the outer container within a groove of the dispenser collar thread to form a locked configuration; and a second rotational movement of the dispenser collar thread about the outer container thread passes the terminus of the dispenser collar over the abutment of the outer container thread and snap-releases the abutment of the outer container from the groove of the dispenser collar thread to form an unlocked configuration; and wherein securement of the first and second lockable threaded connections forms at least part of a plurality of seals for prevention of gas flow from the exterior of the outer container to an interior of the inner container for preservation of a cosmetic substance within the interior of the inner container, and wherein the plurality of seals comprises at least one air-tight seal.

9. The rechargeable collared container of claim 8, wherein securement of the lid to the dispenser collar forms a seal of the at least part of the plurality of seals for prevention of gas flow from the exterior of the outer container to the interior of the inner container and preservation of the cosmetic substance within the interior of the inner container.

10. The rechargeable collared container of claim 8, wherein a first seal of the plurality of seals is formed between the outer container and the inner container collar; a second seal of the plurality of seals is formed between the inner container collar and the dispenser collar; and a third seal of the plurality of seals is formed between the dispenser collar and the lid.

11. The rechargeable collared container of claim 8, wherein the outer container comprises a rigid material and the vent is positioned at a bottom of the outer container.

12. The rechargeable collared container of claim 8, wherein the inner container collar is attached to the outer container prior to attachment of the dispenser collar to the outer container for formation of the at least part of the plurality of seals.

13. The rechargeable collared container of claim 12, wherein the dispenser collar is attached to the outer container prior to attachment of the lid to the dispenser collar for formation of a non-airtight seal of the plurality of seals.

14. The rechargeable collared container of claim 8, wherein the first lockable threaded connection occurs between an inner container collar member and an outer container collar member ridge, wherein the outer container collar member ridge is semi-circumferential such that the inner container collar member is rotatably movable relative to the outer container collar member ridge for transitions between an unlocked configuration and a locked configuration.

* * * * *